US005117811A

United States Patent [19]

Taylor

[11] Patent Number: 5,117,811

[45] Date of Patent: Jun. 2, 1992

[54] CONCENTRIC LIGHTING AND AIR CONDITIONING FIXTURE

[76] Inventor: Robert F. Taylor, 636 W. Commerce Ave., Gilbert, Ariz. 85234

[21] Appl. No.: 709,104

[22] Filed: Jun. 3, 1991

[51] Int. Cl.[5] ..... F24J 2/08; E04D 13/18

[52] U.S. Cl. ..... 126/428; 126/417; 126/440; 359/592; 359/596

[58] Field of Search ..... 126/440, 417, 428, 429, 126/432; 62/309, 304, 311; 350/258, 259, 260, 264; 359/592, 596

[56] References Cited

U.S. PATENT DOCUMENTS 4,085,667 4/1978 Christianson ..... 126/417 X
4,296,733 10/1981 Saunders ..... 126/428
4,324,229 4/1982 Risser ..... 126/417 X
4,329,021 5/1982 Bennett et al. ..... 350/259
4,421,159 12/1983 Lin ..... 126/417 X
4,428,358 1/1984 Adamson ..... 126/417
4,462,392 7/1984 Tipton ..... 126/440 X
4,541,415 9/1985 Mon ..... 126/440
4,616,487 10/1986 Franklin ..... 126/417 X
4,820,020 4/1989 Terrill ..... 350/259

*Primary Examiner*—Larry Jones
*Attorney, Agent, or Firm*—Warren F. B. Lindsley

[57] ABSTRACT

A passive solar ray lighting fixture supported above a roof of a building and extending coaxially within a building light well, a solar ray illuminator in combination with a coaxially arranged air conditioning duct for use in combination with an air conditioning system.

7 Claims, 2 Drawing Sheets

FIG. 1
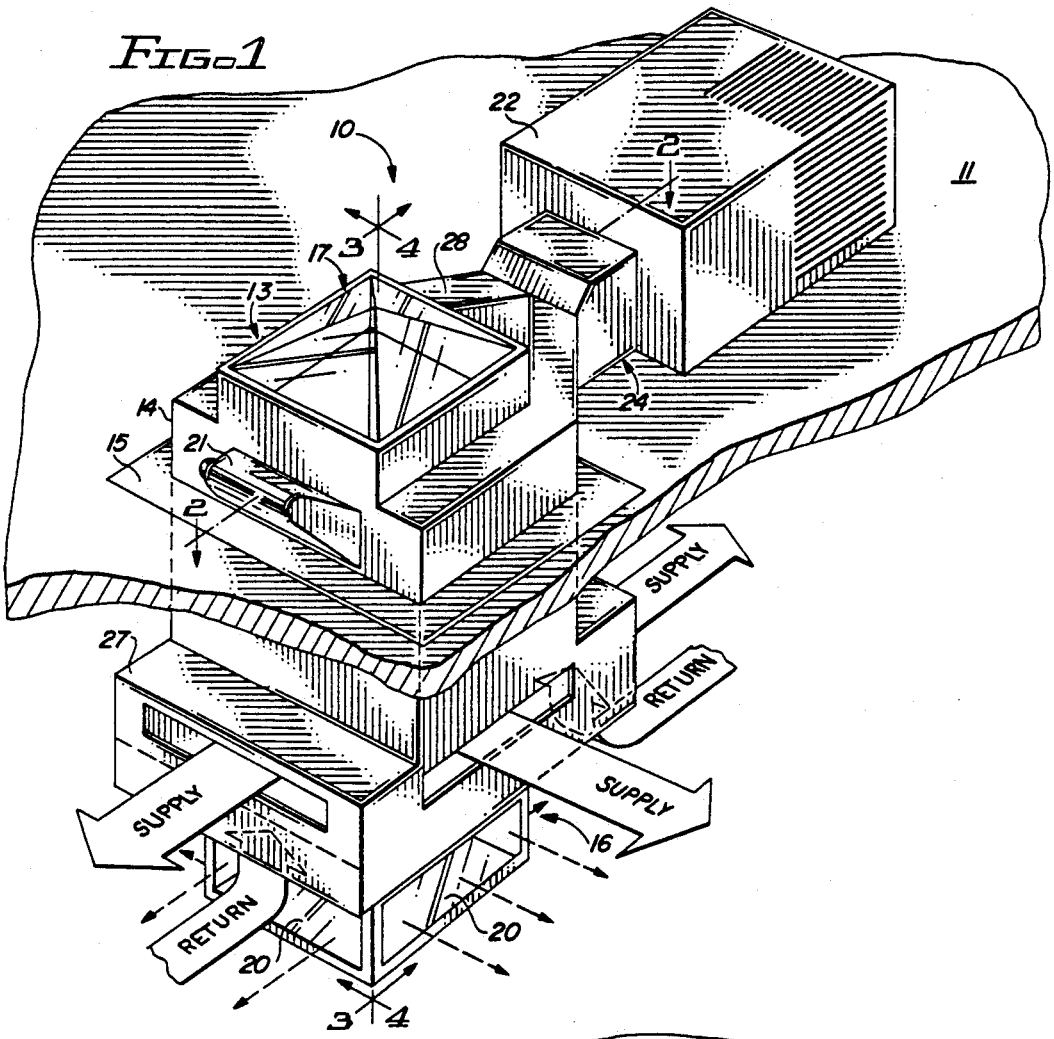
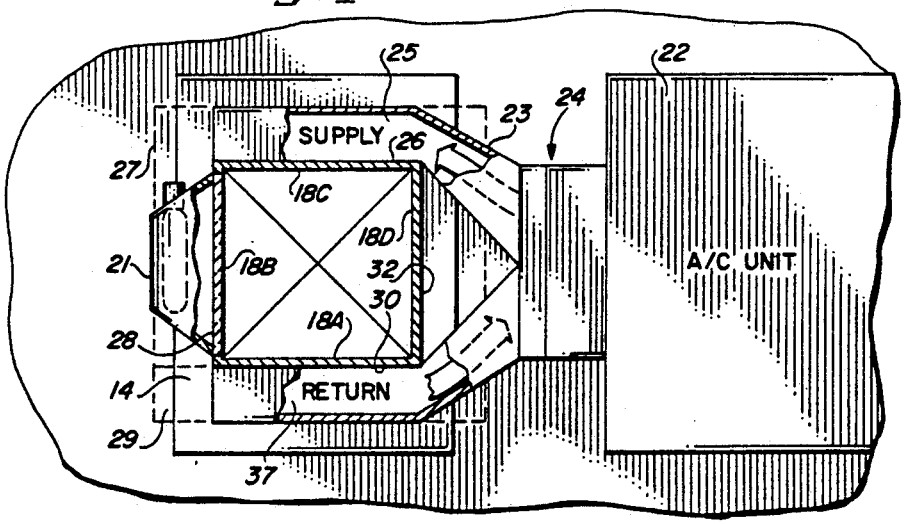
FIG. 2

CONCENTRIC LIGHTING AND AIR CONDITIONING FIXTURE

BACKGROUND OF THE INVENTION

This invention relates to lighting fixtures for illuminating the interior space of a building which embodies a concentric air conditioning function. More particularly, the invention relates to a passive solar day lighting system supported above and coaxially with a building cavity light well and building interior illumination system to diffuse and distribute daylight within the building in combination with a roof mounted air conditioning system that transmits and vents heat and cooling air coaxially through the solar lighting and lens diffusing system.

Over the years, daylighting systems for commercial buildings such as offices, manufacturing plants, schools and department stores have diminished in acceptance in favor of electrical lighting systems, both incandescent and fluorescent. On the other hand, electrical energy rates have continuously increased over recent years and are projected to continue to increase.

While sunlight provides an inexpensive source of interior lighting, it has been difficult to manipulate this light so that a building interior will be provided with adequate light throughout the course of the day. Because the position of the sun in the sky is constantly changing throughout the day, and through the different seasons, a means, preferably passive must be provided for capturing these rays regardless of their orientation on the horizon.

Since the building, regardless of its use, must be air conditioned for today's society, it is desirable to combine the lighting and air conditioning of the building in one concentrically functioning fixture that extends through the roof of the building.

Thus, properly engineered daylighting systems can reduce energy demands and result in substantial energy savings if properly installed and particularly if a common fixture is provided for both lighting and air conditioning functions.

Daylighting systems also provide many tangible benefits such as improving the living and working environments for occupants since the system provides low glare and full spectrum illumination in addition to being aesthetically pleasing.

DESCRIPTION OF THE PRIOR ART

Although numerous prior art exists relating individually to lighting, heating and ventilation of buildings, none appear to anticipate the concentric solar lighting and air conditioning function disclosed herein with the following patents being the closest prior art known.

U.S. Pat. No. 4,296,733 discloses a solar heating and lighting system which employs a ventilating and air conditioning function.

U.S. Pat. No. 4,329,021 discloses a passive solar lighting system for use in lighting the interior of a building having a light transmissive aperture therein which includes a means located near the aperture capable of increasing the angle of incidence which sunlight may enter the aperture.

U.S. Pat. No. 4,820,020 discloses a passive daylighting system having a number of reflectors arranged in vertical and horizontal arrays above a lightwell arranged to increase reflected solar insolation during certain periods in the solar day and to provide shading or blacking primarily during solar mid-day.

SUMMARY OF THE INVENTION

In accordance with the invention claimed a new and improved dual purpose roof mounted fixture is provided which extends through a skylight opening in the roof to provide both lighting and air conditioning functions.

Accordingly, it is one object of this invention to provide a less expensive passive daylighting system which combines lighting and air conditioning functions in a single fixture.

Another object of this invention is to provide a dual purpose roof mounted passive solar lighting system employing a lens for increasing the incident angle of light accepted by the fixture for transmittal to a building interiorally mounted reflector together with the concentric transmission of an air conditioning function.

A further object of this invention is to provide a passive solar lighting system employing a plurality of reflectors for transmitting the solar rays along a conduit to an interiorally mounted lighting fixture concentrically with an air conditioning duct.

A still further object of this invention is to provide a dual purpose roof mounted fixture for providing building interior solar lighting and air conditioning function in a more economical manner than heretofore possible.

These and other objects and advantages of this invention will become more apparent as the description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which:

FIG. 1 is a perspective view of a roof mounted day lighting apparatus embodying a concentric air conditioning system;

FIG. 2 is a cross sectional view of FIG. 1 taken along the line 2—2;

DESCRIPTION OF THE PREFERRED EMBODIMENT

Figure 3:
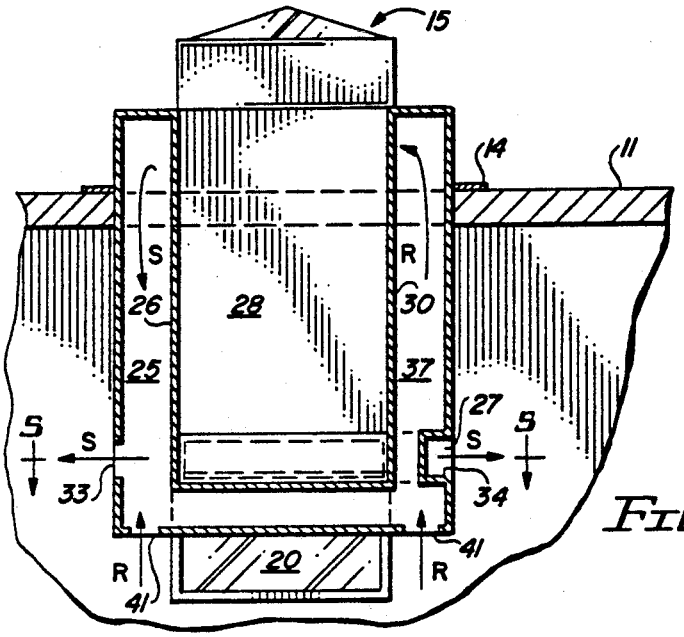
FIG. 3 is a cross sectional view of FIG. 1 taken along the line 3—3.

Referring more particularly to the drawings by characters of reference, FIGS. 1-5 disclose a passive solar lighting and air conditioning system 10 located on a roof 11 of a building and arranged to penetrate into the building to provide regulated and controlled lighting and air conditioning functions for its interior.

The apparatus comprises a curb mounted skylight 13 at the upper end of a light well, duct or channel 14, which is fastened to the roof surface of roof 11 by a flange 15 which extends around and laterally of channel 14 midway of its length. The flange is fastened to the top surface of roof 11 by suitable means will known in the art. The lower end of channel 14 is provided with a light diffusion distribution system 16.

More than one of these solar lighting and air conditioning systems 10 may be mounted on a conventional roof usually located above a space within the building which needs to be illuminated. The roof may be flat or pitched and constructed in any conventional manner. It should be noted that the roof members in a conventional building construction may not have to be cut in order for the disclosed lighting system to be installed and to function properly with the associated air conditioning apparatus connected thereto. It will be appreciated that the day lighting and air conditioning system of the present invention may be used with almost any type of commercial, institutional, industrial or residential structure where single or multiple roof penetrations are structurally allowable.

The present invention is directed particularly to a passive solar sky light for use in lighting the interior of a building having a light transmissive passageway formed therein by channel 14 and which includes a lens means 17 in the skylight 13 located near the entrance of channel 14 which increases the angle of incidence of the sunlight entering the channel beyond that which would enter in the absence of this type of lens means. A plurality of reflective surfaces 18A–18D arranged in channel 14 reflect and direct the solar light rays 19 transmitted through lens means 17 to target surfaces 20 within the building to provide usable light for the interior of the building adjacent this fixture. Reflective surfaces 18A–18D are carried by or form the inner surfaces of channel 14 which holds them in place.

Lens means 17 may be any suitable lens which, for example, may be a prismatic refractor stamped out of a plastic translucent material oriented so that its inherent prisms are longitudinally aligned in an east-west direction. This orientation permits capture of a maximum amount of sunlight regardless of the season the year and without the need of a tracking system. However, it is intended that the invention may include any form of lens and sun tracking system so desired.

Figure 4:
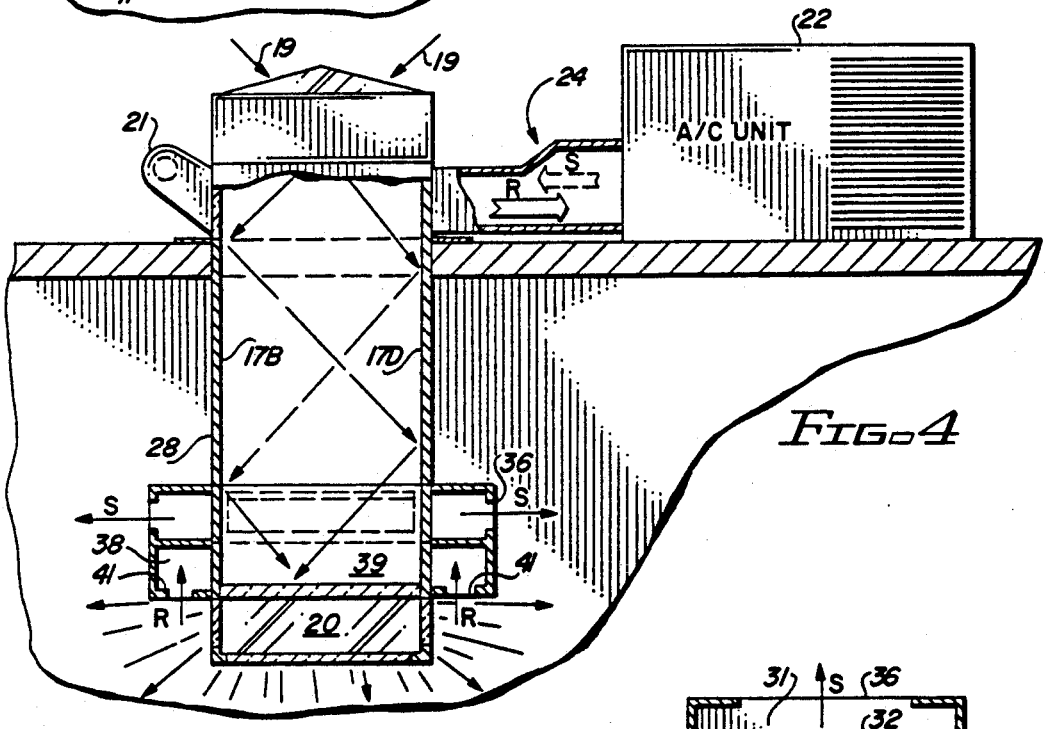
FIG. 4 is a cross sectional view of FIG. 1 taken along the line 4—4.
Figure 5:
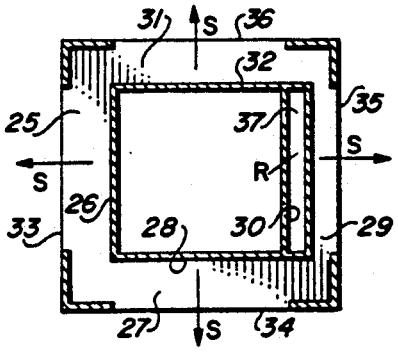
FIG. 5 is a cross sectional view of FIG. 3 taken along the line 5—5 illustrating that the supply air may be discharged on all four sides of the lighting apparatus.

As shown in FIG. 4, solar rays 19 received by lens means 17 are reflected by the lens to reflective surfaces 18A–18D which transmits them to the target surfaces 20 for room area illumination.

To supplement this illumination during daylight and evening hours a suitable electric light 21, which could be a fluorescent light, is mounted in a fixture which is secured to the outer surface of the upper position of channel 14. This mounting is above the roof and may be easily serviced when needed from roof top.

Thus, it is within the scope of this invention to provide any suitable channel 14 which is mounted on a curb 12. Curb 12 surrounds channel 14 which is provided with a skylight 13 comprising a lens means 17 at roof top and extending through the roof terminating near the inner surface of the roof with a target surface 20 for receiving the reflected solar rays from lens means 17 by means of a plurality of reflective surfaces 18A–18D.

In order to cause this solar lighting system to provide a dual function, an air conditioning system 22 is added to and built into the solar lighting system.

This air conditioning system may be any suitable heating and air conditioning system 22 that can be roof mounted with its supply and return ducts, if any, entering and leaving the building concentric with the solar lighting channel 14.

As shown in FIGS. 1–5, the air conditioning system 22 is connected to one leg 23 of a Y-shaped duct 24 which connects the supply of the air conditioning system 22 to a duct 25 which is formed to extend vertically along the length of side 26 of channel 14 connecting to a rectangular duct 27 at the bottom thereof that passes over side 28 of channel 14. Duct 27 is connected to a smaller duct 29 that extends along the base of side 30 of duct 27 which duct 29 also extends along sides 26 and 28 of channel 14.

Duct 31 interconnects ducts 29 and 25 along side 32 of channel 14 with ducts 27, 29 and 31 being all at the same level along the base of channel 14, as shown in the drawings.

Thus, the supply of air or heat from the air conditioning system 22 can be furnished to the interior of the building through the four registers 33–36, one of which is formed in each side of ducts 25, 27, 29 and 31.

The air return ducts are arranged in a similar manner in the apparatus with a duct 27 similar to supply duct 25 being arranged along the outside 30 of channel 14 to extend vertically along its length. Duct 37 is narrowed down to approximately one half of its width as shown in FIG. 3, to interconnect with ducts 38, 39 and 40 which extend around the base of outsides 28, 26 and 32, respectively juxtapositioned to and below the air supply system formed by ducts 25, 27, 29 and 31 with registers 41 formed in each of ducts 37, 38, 39 and 40 of the air return system of the claimed invention.

Thus, it is noted that a concentric solar and/or electric lighting well or sky light is disclosed in combination with the supply ducts of an air conditioning system.

Although but one embodiment of the invention has been illustrated and described, it will be apparent to those skilled in the art that various changes and modifications may be made therein without departing from the spirit of the invention or from the scope of the appended claims.

What is claimed is:

1. A concentric lighting and air conditioning fixture for a building comprising:

a sky light having a channel extending through the roof of a building for interior lighting thereof, means for receiving solar rays in an opening in said channel above said roof and reflecting said ray along the interior of said channel until received by an illuminator at the other end of said channel within the building, a first duct means mounted along at least a part of the length of the outside of one side of said channel and at least partially around said other end thereof for supplying conditioned air under pressure from an air conditioning system, a second duct means mounted along at least a part of the outside of another side of said channel and at least partially around said other end thereof for providing a return duct for an air supply under pressure from said air conditioning system, said means further comprising a lens at one end of said channel, and reflective surfaces mounted along the inside of said channel for receiving refracted light from said lens and deflecting the light to said illuminator.

2. The concentric lighting and air conditioning system set forth in claim 1 in further combination with:

registers provided in each of said first and second duct means along each side of said channel at said other end thereof.

3. The concentric lighting and air conditioning fixture set forth in claim 1 in further combination with:

electric light means mounted on the outside of said one end of said channel above the roof of an associated building and below said lens for directing electric light rays into said channel.

4. The concentric lighting and air conditioning fixture set forth in claim 1 in further combination with:

an evaporative cooler for furnishing cool air under pressure to said first duct means.

5. The concentric lighting and air conditioning fixture set forth in claim 1 in further combination with:

an air conditioning apparatus connected to said first and second duct means.

6. The concentric lighting and air conditioning fixture set forth in claim 1 in further combination with:

a curb mounted around an opening in the roof of a building, and means for affixing said channel to said curb.

7. The concentric lighting and air conditioning fixture set forth in claim 1 wherein:

said lens comprises a passive solar ray collecting means.

* * * * *